United States Patent [19]

Bunger

[11] Patent Number: 4,625,640

[45] Date of Patent: Dec. 2, 1986

[54] REGISTERED MULTIPLE STAMPING

[76] Inventor: Hilary Bunger, 40 Little Fox La., Weston, Conn. 06883

[21] Appl. No.: 689,773

[22] Filed: Jan. 8, 1985

[51] Int. Cl.[4] ..... B41K 1/38

[52] U.S. Cl. ..... 101/327; 33/184.6; 101/125; 101/368

[58] Field of Search ..... 101/327, 333, 368, 108, 101/405, 125, 406; 33/184.6

[56] References Cited

U.S. PATENT DOCUMENTS

| | | | |
|---|---|---|---|
| 518,515 | 4/1894 | Smith et al. | 33/184.6 |
| 548,226 | 10/1895 | Scotford | 33/184.6 |
| 581,525 | 4/1897 | Smith et al. | 33/184.6 |
| 743,762 | 11/1903 | Shea | 101/368 |
| 3,227,072 | 1/1966 | Muskin | 101/103 |
| 3,227,079 | 1/1966 | Muskin | 101/103 X |
| 3,282,209 | 11/1966 | Muskin | 101/103 X |
| 3,403,623 | 10/1968 | Blackwood | 101/368 |
| 3,756,153 | 9/1973 | Cohen | 101/368 |
| 3,817,178 | 6/1974 | Hagen | 101/327 X |
| 3,853,411 | 12/1974 | Ciraolo | 101/327 X |
| 3,951,062 | 4/1976 | Abramson | 101/368 X |
| 3,972,284 | 8/1976 | Bell | 101/368 X |

FOREIGN PATENT DOCUMENTS

| | | | |
|---|---|---|---|
| 545997 | 3/1932 | Fed. Rep. of Germany | 101/327 |

*Primary Examiner*—Edgar S. Burr
*Assistant Examiner*—Moshe I. Cohen
*Attorney, Agent, or Firm*—Watson Cole Grindle & Watson

[57] ABSTRACT

A series of individual imprinting devices each comprising an imprinter including an imprintable surface for retaining an image mounted at a given fixed position thereon which is registered with respect to each one of the series of imprinting devices. Each of the imprinting devices includes a lip extending from one edge and an index mark adjacent the lip. A registration device is adapted to be held in a fixed position with respect to an imprintable medium and includes a groove to pivotally receive the lip with a registration mark above the groove for separately, removably retaining each of the imprinting devices successively in aligned registration with the imprintable medium by positioning the lip in the groove with the registration mark and the index mark aligned with each other. A composite image is formed on the imprintable medium by successive application of the lips of said series of individual imprinting devices with the groove of the registration.

3 Claims, 12 Drawing Figures

REGISTERED MULTIPLE STAMPING

BACKGROUND OF THE INVENTION

The method and apparatus of the invention relates to the stamping or imprinting of multiple decorative impressions on a printable medium, and more particularly to such method and apparatus wherein multiple impressions are stamped or imprinted successively in registered alignment such that the successive imprints are in registration to form a desired imprint of a graphic image.

Existing multi-colored printing devices, either using stamps or plates, register one color to another by locking the stamp or plate in a registration device which can be adjusted to form successive colored imprints in registration with one another. Such devices are often complex and expensive because of the construction of the registration device to obtain the necessary registration for each of the individual, separate impressions with respect to one another.

U.S. Pat. Nos. 518,515, 548,226 and 581,525 disclose various hand printing devices using gauged typeguides for aligning or registering successive characters or symbols on a printing medium such as paper and are illustrative of the aforementioned known printing devices. Such hand printing apparatus rely on a gauged typeguide to obtain registration of each of the successive imprints with respect to one another such that the imprinted characters and/or symbols are in registered alignment.

U.S. Pat. Nos. 3,227,072, 3,227,079 and 3,282,209 each disclose multiple-sectioned stamp sections movable relative to one another for the purpose of producing independent sections of an overall design or decoration on a medium such as paper. Such stamping devices are rather complex and expensive, in part, because of the structure for mounting the independent printing sections to be movable to enable imprints that are registrable with respect to one another.

U.S. Pat. No. 743,762 discloses a device for guiding ledger footings in the form of a hand stamp with a line-guide finger adapted to be aligned with the ruled lines of a ledger such that marks or letters can be imprinted thereon. However, such apparatus could not be used for multiple stamping to form a resultant coordinated imprint as the alignment is too inaccurate for registration of successively applied stampings to form a coordinated imprint.

There is thus a need to provide an imprinting device that is capable of producing successive imprints or stampings in registered alignment to form a coordinated graphic imprint and which is less complex and costly than the aforementioned stamping apparatus, and yet which is reliable and durable for repetitive usage.

Moreover, such need has been increased by the current fad in the graphic arts and crafts fields using rubber stamps of graphic images to decorate stationery, cards, wrapping paper, etc., with multi-color imprints.

SUMMARY OF THE INVENTION

The method and apparatus of the invention represents a new concept for multi-colored decorative stamps having automatic registration of one color to another. In its simplest two color form the two images (one for each color) are each placed in a registered position, one to the other, but in a separate stamp device. The first color impression is applied by placing the first stamp in a registration device that assures that each color will be printed in exactly the same position on the print medium such as, for example, paper. The first stamp is removed from the registration device and the second stamp is placed in the registration device and then an imprint is formed in the same manner as the first imprint.

Automatic, exact registration is assured by the fact that each of the successive images are placed in perfect register on the respective stamp during manufacture thereof. The graphics artist need only keep the respective stamp in a fixed position within the registration device, which does not move. Thus, the key or primary consideration in the method and apparatus of the invention is in registering the respective printing images in their respective stamps during manufacture so that successively made imprints are in registered relationship with each other to form, for example, a coordinated design. Preferably the successive images are each of a different color so that a multi-color imprint results from the successive stampings.

The device to register the stamp in the registration device could be, for example, a "corner" or any kind of a "key" which engages the stamp in abutting relationship. It is also evident that the method and apparatus of the present invention can be used for multi-color imprinting in any number of colors or for monochromatic imprinting where successive imprints are made in one color only.

BRIEF DESCRIPTION OF THE DRAWINGS

The above objects, advantages and features of the invention will be more readily apparent from the following description of a preferred embodiment of the best mode of carrying out the invention when taken in conjunction with the following drawings, wherein.

DETAILED DESCRIPTION

The following description is taken with respect to a two-color format solely for the purpose of explaining the salient features of the invention. It is readily apparent to those skilled in the graphic arts that the method and apparatus of the invention can be applied to any number of successive multi-color or monochromatic imprints.

Figure 1:
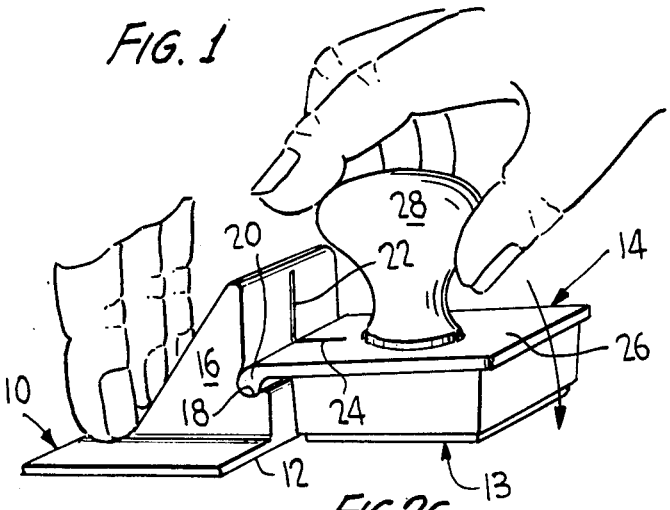
FIG. 1 illustrates the principle of operation of the registration device and stamp containing the image to be imprinted in accordance with the invention.

With respect to FIG. 1, registration device 10 includes base portion 12 designed to be held in a fixed position with respect to a medium (not shown) to be stamped by an image 13 on imprinter 14. Registration device 10 further includes upstanding portion 16 with groove 18 engageable with lip 20 of imprinter 14. To operate the imprinter mechanism shown in FIG. 1, imprinter 14, and more specifically lip 20 is engaged in groove 18 and slid therein to be in alignment with registration mark 22 on upstanding portion 16 and an index mark 24 on the upper surface 26 of imprinter 14. Imprinter 14 is grasped by the graphic artist via handle 28 as illustrated in FIG. 1 to accomplish the aforedescribed operations, while the other hand of the graphic artist firmly positions registration device 10 with respect to the medium on which the image is to be imprinted.

With imprinter 14 registered with registration device 10 as described above, imprinter 14 is rotated within groove 18 in the direction of the arrow in FIG. 1 such that "inked" image 13 on the bottom surface of imprinter 14 contacts the surface of the imprinting medium whereby the "inked" image is transferred thereto. That image may be, for example, that illustrated in FIG. 2A, namely the outline of a frog.

Imprinter 14 is then rotated upwardly, withdrawn from groove 18, and another imrinter, identical to imprinter 14, but with a different "inked" image, is inserted in groove 18 and aligned with registration device 10 as previously described. The other imprinter is then rotated as described above to transfer the "inked" image onto the imprinting medium. The second "inked" image may, for example, correspond to that illustrated in FIG. 2B, namely a coloration of the regions adjoining the outline of the frog such that the total "inked" image on the imprinting medium is as shown in FIG. 2C.

The imprinting medium may be stationery, cards, wrapping paper, etc., and may be formed of any surface capable of accepting an impression. It is apparent that the invention is not limited to a particular type of imprinting surface. The only limitation is that the surface to be imprinted must have a sufficiently flat area to accommodate the image. The invention is also not limited to the transfer of images by ink, but may include the embossment of successive images onto an appropriate imprintable medium.

The key to the registration of the two or more "inked" images is that each respective image on a series of imprinters is placed on the bottom surface of each imprinter 14 in a registered position with respect to lip 20 (and hence groove 18) such that when index 24 of imprinter 14 is aligned with registration mark 22, any number of images can be "inked" successively in exact registration with one another by repetitively repeating the steps described above.

Figure 2A:
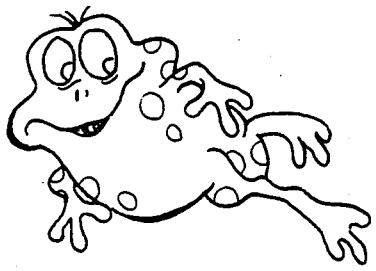
FIGS. 2A, 2B and 2C respectively represent successive imprints of images forming a registered final imprint of a frog formed by the apparatus illustrated in FIG. 1.
Figure 2B:
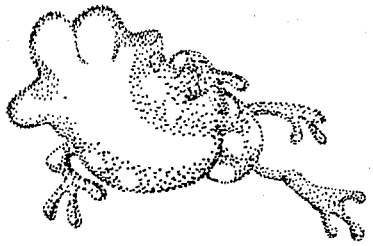
Figure 2C:
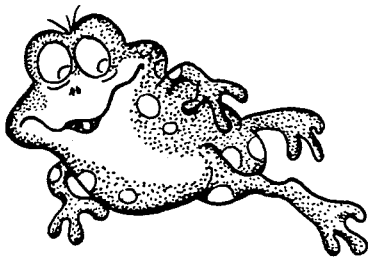
Figure 3A:
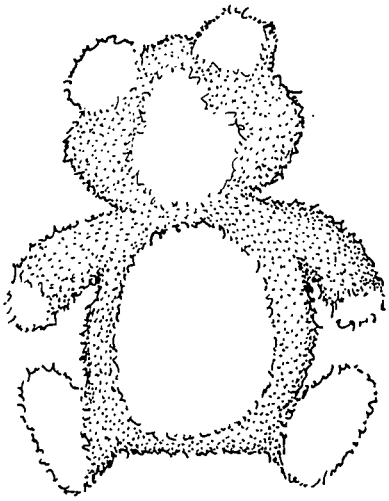
FIGS. 3A, 3B and 3C respectively represent yet another illustrative example of a decorative imprint (FIG. 3C) formed by successive imprinting of images 3A and 3B using the imprinting apparatus of FIGS. 1 or 4A and 4B.
Figure 3C:
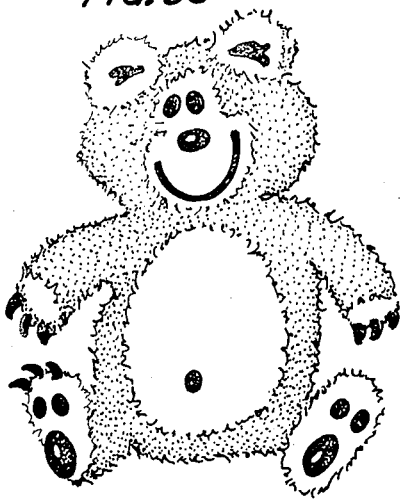
Figure 3B:
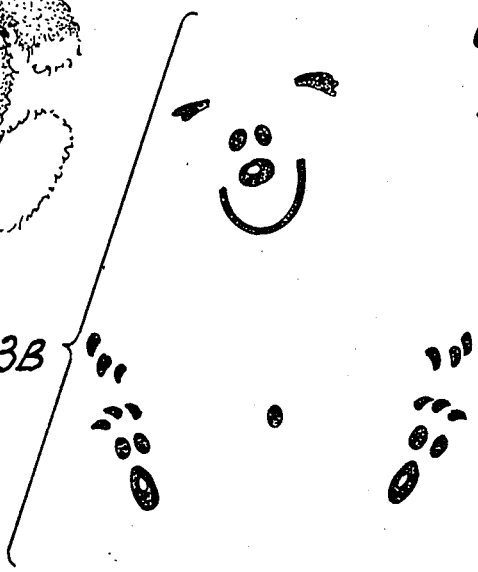

FIGS. 3A and 3B respectively illustrate another exemplary image transfer onto an imprinting surface, again depicting a two-color transfer process in which the outline of the image is transferred (FIG. 3A) prior to transfer of the features of the image (FIG. 3B), which is the reverse of the process illustrated in FIGS. 2A and 2C. The resultant imprint is shown in FIG. 3C.

Figure 4A:
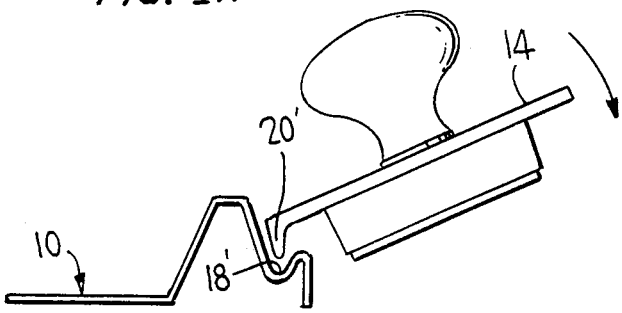
FIGS. 4A and 4B illustrate a preferred embodiment of the invention showing the use of a "stop" as a registration means.
Figure 4B:
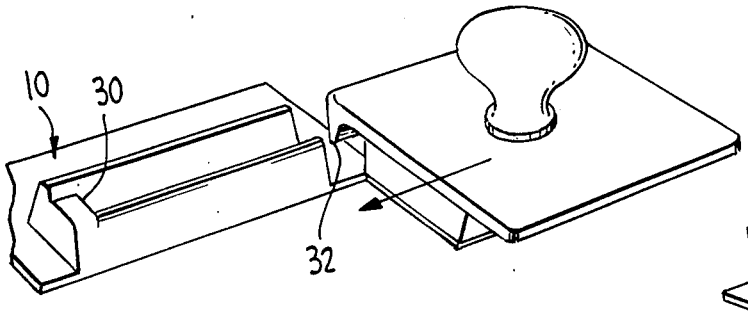

FIGS. 4A and 4B illustrate a preferred modified embodiment of the registration device 10 and imprinter 14 illustrated in FIG. 1. As shown in cross section in FIG. 4A, a lip 20' of imprinter 14 engages in groove 18' of registration device 10. However, in the preferred modified embodiment, groove 18' includes a stop member 30 (FIG. 4B) which abuts end portion 32 of lip 20' to provide registration of the "inked" image on the bottom surface of imprinter 14. Stop member 30 affords a more positive and reliable means of registration than does the alignment of registration mark 22 and index mark 24 as shown in the embodiment of FIG. 1. When the end portion 32 of lip 20' engages stop member 30, imprinter 14 is rotated such that the inked image is transferred to the imprinting medium (not shown). It is apparent that registration device 10 must be held in fixed position with respect to the imprinting medium for the successively applied "inked" images to be in registration on the imprinting medium. This can be easily accomplished by holding registration device 10 in position with one hand, while the other hand manipulates the imprinter 14 in the manner described above.

As has been noted above, a critical and important aspect of the method and apparatus of the invention resides in the placement of one image in register with another at the point of manufacture of the multi-colored printing device. The means for accomplishing such registration are not limited to any one particular technique but are diverse. For example, a stamp can be made with molded plastic images that are positioned with respect to one another at the time of manufacture of the stamp die. Also, any number of registration systems could be used to position the image onto a handle, such as adding registration marks to the artwork, visually aligning the image onto the handle using a grid, and then removing the registration marks.

Figure 5A:
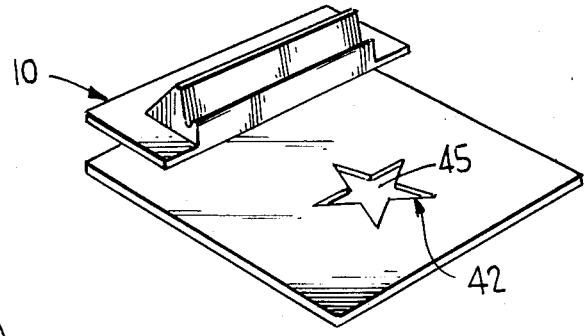
FIGS. 5A, 5B and 5C illustrate a preferred embodiment of a process for placing one image in registration to another using a matrix such that the image is in a registered position within a stamp device.
Figure 5B:
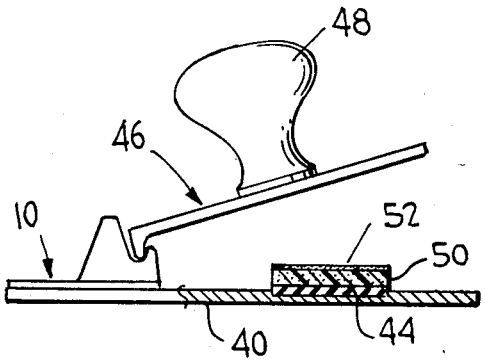
Figure 5C:
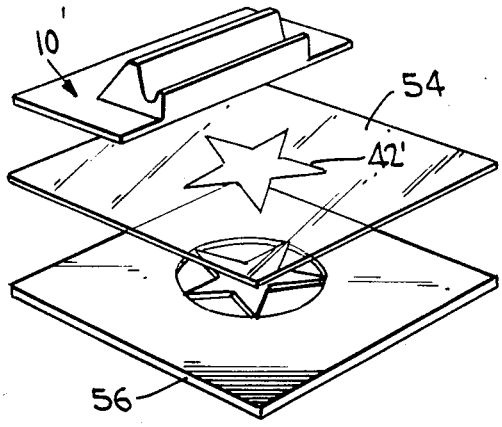

FIGS. 5A, 5B and 5C illustrate a preferred embodiment of the best mode of carrying out a process for placing one image in register with another image during manufacture of the imprinting device of the invention. Each image uses a matrix and a registration device 10 that is temporarily attached to the matrix 40 as shown in FIG. 5A. Image 42, such as for example a "star" as shown in FIG. 5A, is formed in matrix 40. As shown in FIG. 5B, a vulcanized rubber image 44 (first color) is placed in cavity 45 of matrix 40. A stamp 46 with handle 48 is put into registration device 10 and slid into abutting relationship with a stop member (not shown) as previously described with respect to FIGS. 4A and 4B. Handle 48 is pressed downward until stamp 46 "picks up" the image 42. Rubber image 44 includes a foam backing 50 and adhesive 52 as shown in FIG. 5B.

After the first stamp descibed above is made, a clear film 54, as shown in FIG. 5C, is attached to another registration device 10' and the first stamp 46 is used to make an impression on the film (printed image 42'). Image 42' is aligned over matrix 56 (second color). When images 42' and 56 are in perfect alignment, registration device 10' is attached to matrix 56 in that aligned position, and clear film 54 is removed. The above process as described with respect to FIG. 5B is then repeated to make the second stamp. When the two stamps are used as described above with respect to FIGS. 4A and 4B, the two colored images will print in registration with respect to one another.

It is understood that the above-described process is not limited to a two-image process, but that any number of stamps can be made to be used in conjunction with one another to produce an integrated and registered imprint.

Moreover, the above embodiments are only illustrative of the method and apparatus of the invention. The invention is not limited to the transfer of "inked" images, but also can be applied to the embossment of stationery, for example. Also the "images" transferred to the imprinting medium can be alpha/numeric characters, symbols, or designs, etc., other than the caricatures of animals as depicted herein.

It is the intention of the inventor that the invention not be limited by the various embodiments described herein, but that the invention be defined by the following claims which are to be accorded the equivalents as defined herein and the graphics art.

What is claimed is:

1. Apparatus for imprinting successive images in registered relationship onto the surface of an imprintable medium to form a composite imprint, comprising:

a series of individual imprinting devices each comprising an imprinter including an imprintable surface for retaining an image mounted at a given fixed position thereon, said fixed position being registered with respect to each one of the series of imprinting devices, each of said imprinting devices having a lip extending from one edge thereof, and an index mark adjacent said lip; a registration device adapted to be held in fixed position with respect to said imprintable medium and including a groove to pivotally receive said lip and a registration mark above said groove for separately, removably retaining each of said imprinting devices successively in aligned registration with said imprintable medium by positioning said lip in said groove with said registration mark and said index mark aligned with each other;

the successive application of the lips of said series of individual imprintable devices with the groove of said registration device with the index and registration marks aligned enabling the production of a composite image on said imprintable medium;

each one of said series of imprinting devices further includes a pair of opposed sides, one said side including said imprintable surface and bearing said image, and the other opposed side including means for manipulating each imprinting device to form an imprint of said image on the surface of said imprintable medium.

2. The imprinting apparatus as claimed in claim 1 wherein each one of said series of imprinting devices further includes a foam backing member having opposed surfaces and attached to said one side by adhesive and said image being formed on the other of said opposed sides.

3. The imprinting apparatus as claimed in any one of claims 1 or 2 wherein said groove includes a stop member and said lip abutting said stop member with each of said individual imprinting devices engaging said registration device.

* * * * *